US006036543A

United States Patent [19]

Panis et al.

[11] Patent Number: 6,036,543

[45] Date of Patent: Mar. 14, 2000

[54] CONNECTOR ASSEMBLY

[75] Inventors: Werner Panis, Tessenderlo; Gert Droesbeke, Bonheiden; Eddy Kamiel Creele, Dendermonde, all of Belgium

[73] Assignee: Framatome Connectors International, Courbevoie, France

[21] Appl. No.: 08/974,447

[22] Filed: Nov. 20, 1997

Related U.S. Application Data

[63] Continuation of application No. 08/627,575, Apr. 4, 1996, abandoned, and a continuation of application No. 08/627,271, Apr. 4, 1996, abandoned.

[51] Int. Cl.[7] ..... H01R 9/03

[52] U.S. Cl. ..... 439/607; 439/717; 439/610

[58] Field of Search ..... 439/607–610, 439/98, 101, 108, 714, 717, 701

[56] References Cited

U.S. PATENT DOCUMENTS

| | | | |
|---|---|---|---|
| 4,753,614 | 6/1988 | Weiner | 439/717 |
| 4,826,443 | 5/1989 | Lockard | 439/610 |
| 5,108,313 | 4/1992 | Adams | 439/610 |
| 5,387,130 | 2/1995 | Fedder et al. | 439/607 |

FOREIGN PATENT DOCUMENTS 93 11 781 11/1993 Germany .

*Primary Examiner*—Hien Vu
*Attorney, Agent, or Firm*—Perman & Green, LLP

[57] ABSTRACT

A connector assembly for connecting a shielded cable with a plurality of conductors and a common shielding to a printed circuit board comprises a first connector having a housing of insulating material with contacts connected with the conductors and a metal hood connected with the common shielding. The housing is accommodated in the hood and comprises an insertion part protruding out of the hood along its complete circumference. The connector assembly comprises a second connector with a shielding lying at a distance from the second connector, the second connector having a receiving space for receiving the insertion part of the housing. The second connector with the shielding is mounted on the printed circuit board and the shielding is connected to a corresponding connector of the printed circuit board. The hood is provided with at least one projecting flange connected to the shielding of the second connector when the insertion part of the housing is inserted into the receiving space of the second connector.

11 Claims, 7 Drawing Sheets

CONNECTOR ASSEMBLY

CROSS REFERENCE TO RELATED APPLICATIONS

This is a continuation of U.S. patent application Ser. No. 08/627,575, filed Apr. 4, 1996 and U.S. patent application Ser. No. 08/627,271 filed Apr. 4, 1996 both abandoned.

BACKGROUND OF THE INVENTION

The invention relates to a connector assembly for connecting a shielded cable with a plurality of conductors and a common shielding to a printed circuit board, said connector assembly comprising a first connector having a housing of insulating material with contacts connected with said conductors and a metal hood connected with said common shielding, wherein the housing is accommodated in the hood, said connector assembly further comprising a second connector with a shielding.

U.S. Pat. No. 5,108,313 discloses a connector assembly with a first connector having a hood extending along all faces of the insertion part of the housing adapted to be inserted in a complementary connector, in order to provide a connection of the shielding of the cable with the shielding of the complementary connector.

The invention aims to provide a connector assembly of the above-mentioned type wherein the connection of the hood of the first connector to the shielding of the second connector occurs outside and at a distance from the second connector.

SUMMARY OF THE INVENTION

According to the invention a connector assembly is provided for connecting a shielded cable with a plurality of conductors and a common shielding to a printed circuit board, said connector assembly comprising a first connector having a housing of insulating material with contacts connected with said conductors and a metal hood connected with said common shielding, wherein the housing is accommodated in the hood and comprises an insertion part protruding out of the hood along its complete circumference, said connector assembly comprising a second connector with a shielding lying at a distance from the second connector, said second connector having a receiving space for receiving said insertion part of the housing, wherein said second connector with said shielding are mounted on the printed circuit board and said shielding is connected to a corresponding connector of the printed circuit board, wherein said hood is provided with at least one projecting flange connected to the shielding of said second connector when the insertion part of the housing is inserted into the receiving space of said second connector.

BRIEF DESCRIPTION OF THE DRAWINGS

The invention will be further explained by reference to the drawings in which some embodiments of the connector assembly according to the invention are schematically shown.

DETAILED DESCRIPTION OF THE PREFERRED EMBODIMENTS

Figure 3:
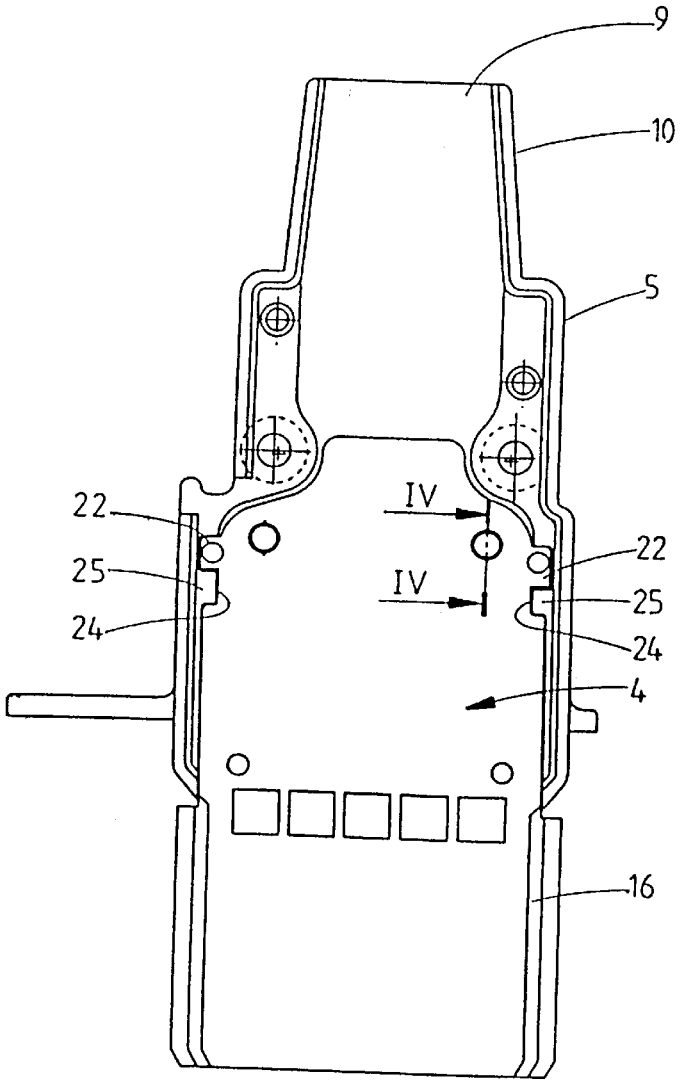
FIG. 3 is a view of the first connector of FIG. 1 wherein one hood part has been removed.
Figure 4:
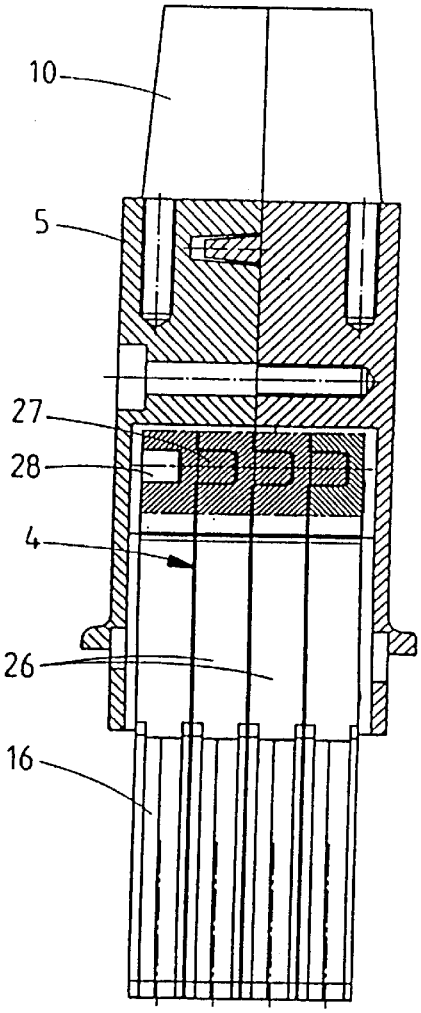
FIG. 4 is a schematically shown cross-section of the first connector of FIG. 1 with a partially shown section according to the line IV—IV of FIG. 3.
Figure 5:
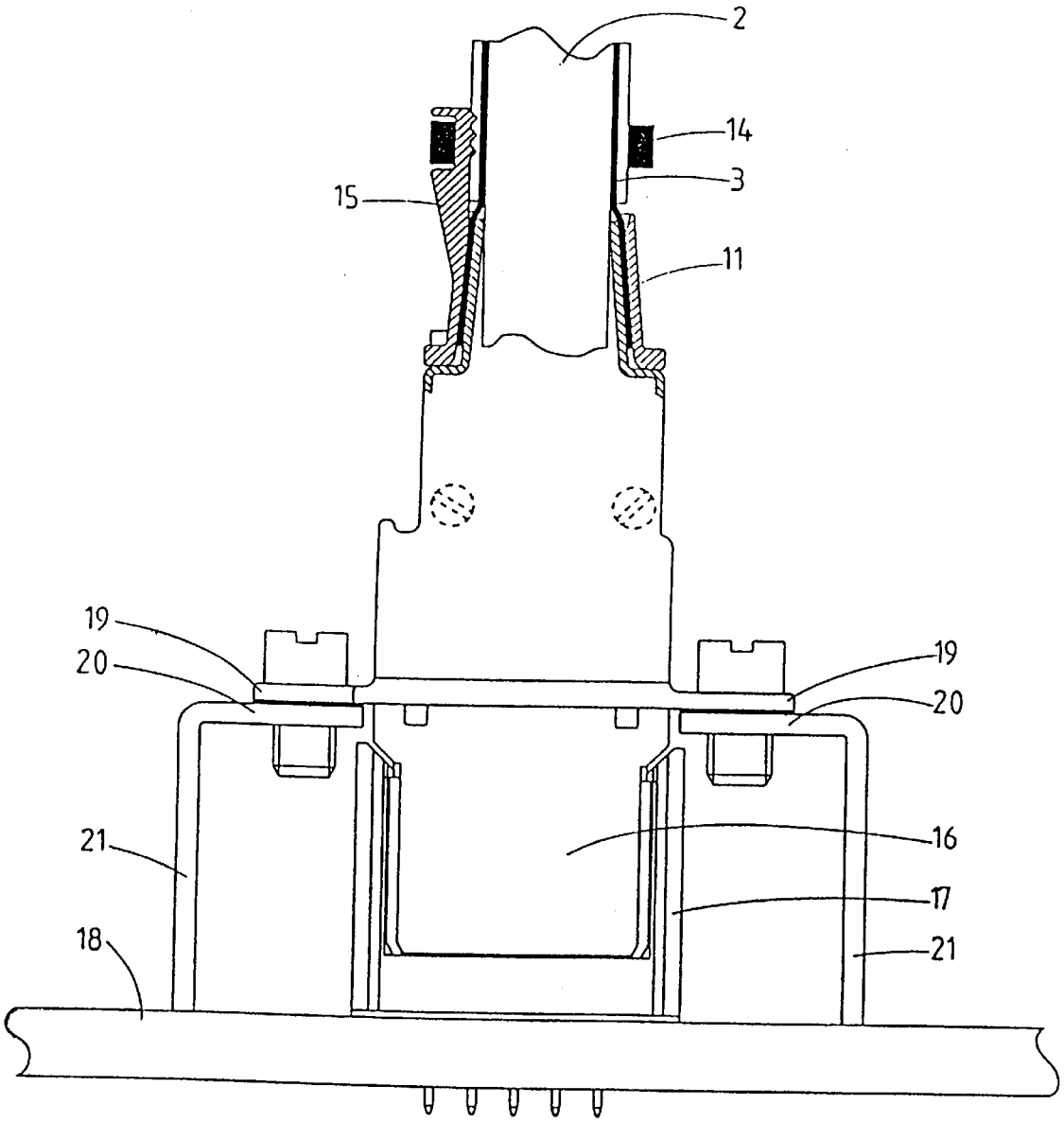
FIG. 5 shows the first connector of FIG. 1 as inserted into a second connector of the connector assembly of the invention.

Referring to FIGS. 1–5 there is shown a first connector 1 for a cable 2 with a plurality of conductors 200 and a common shielding 3 shown in FIG. 5. The connector 1 comprises a housing 4 of insulating material in which contacts 202 are received, and to which conductors 200 can be connected. Further, the connector comprises a metal hood 5 having two parts 6 and 7 which can be interconnected by means of screws 8. The shielding 3 of the cable 2 is connected to the hood 5 by means of an upright collar 9 with a conical outer wall 10 and a ring 11 with a conical inner wall 12. As the ring 11 is attached to the hood 5 by means of screws 13, the shielding 3 is clamped between the conical walls 10 and 12. Further details are described in U.S. patent application Ser. No. 08/627,451 of the same date assigned to the same assignee. A strain relief is obtained by means of a clamping strip 14 clamping the cable 2 against an extension 15 of the ring 11.

As shown in the drawings, the housing 4 comprises a lower part or insertion part 16 protruding out of the hood 5 along its complete circumference. Thereby the connector 1 can be inserted into a complementary or second connector 17 with this lower part 16, wherein the space within the connector 17 can be fully used for contact pins cooperating with the contacts of the housing 4. For connecting the shielding 3 of the cable 2 through the hood 5 to the shielding/ground of a printed circuit board 18 on which the complementary connector 17 is mounted, the hood 5 has two diametrically opposed flanges 19 which can be attached to flanges 20 as shown in FIG. 5. These flanges 20 are part of a shielding 21 or cage surrounding the complementary connector 17. This cage 21 is of course connected with shielding/ground conductors of the printed circuit board 18 in a manner not further shown.

The housing 4 is provided with lugs 22 engaging into slots 23 of the hood 5 in its mounted position in order to fix the housing 4 in the hood 5. The housing 4 further comprises slots 24, edges 25 of the hood 5 engaging into these slots. In the embodiment of FIGS. 1–5 the housing is an assembly of four equal modules 26 each having at one side two pins 27 (see FIG. 4) and at the opposite side two aligned bores 28, in which the pins 27 of a preceding module 26 can be conformably and fittingly received. Each module 26 further comprises two lugs 22 and recesses 24. The pins 27 of the module 26 lying at the right side in FIG. 4 are removed before the housing 4 is mounted within the hood 5. Removing the pins 27 can be easily done by breaking off by means of a suitable tool.

Figure 2:
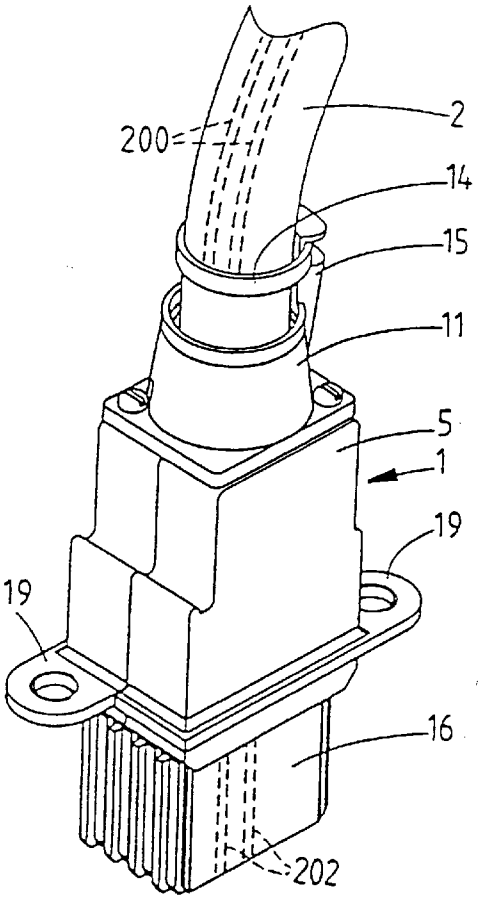
FIG. 2 shows the first connector of FIG. 1 as assembled.
Figure 1:
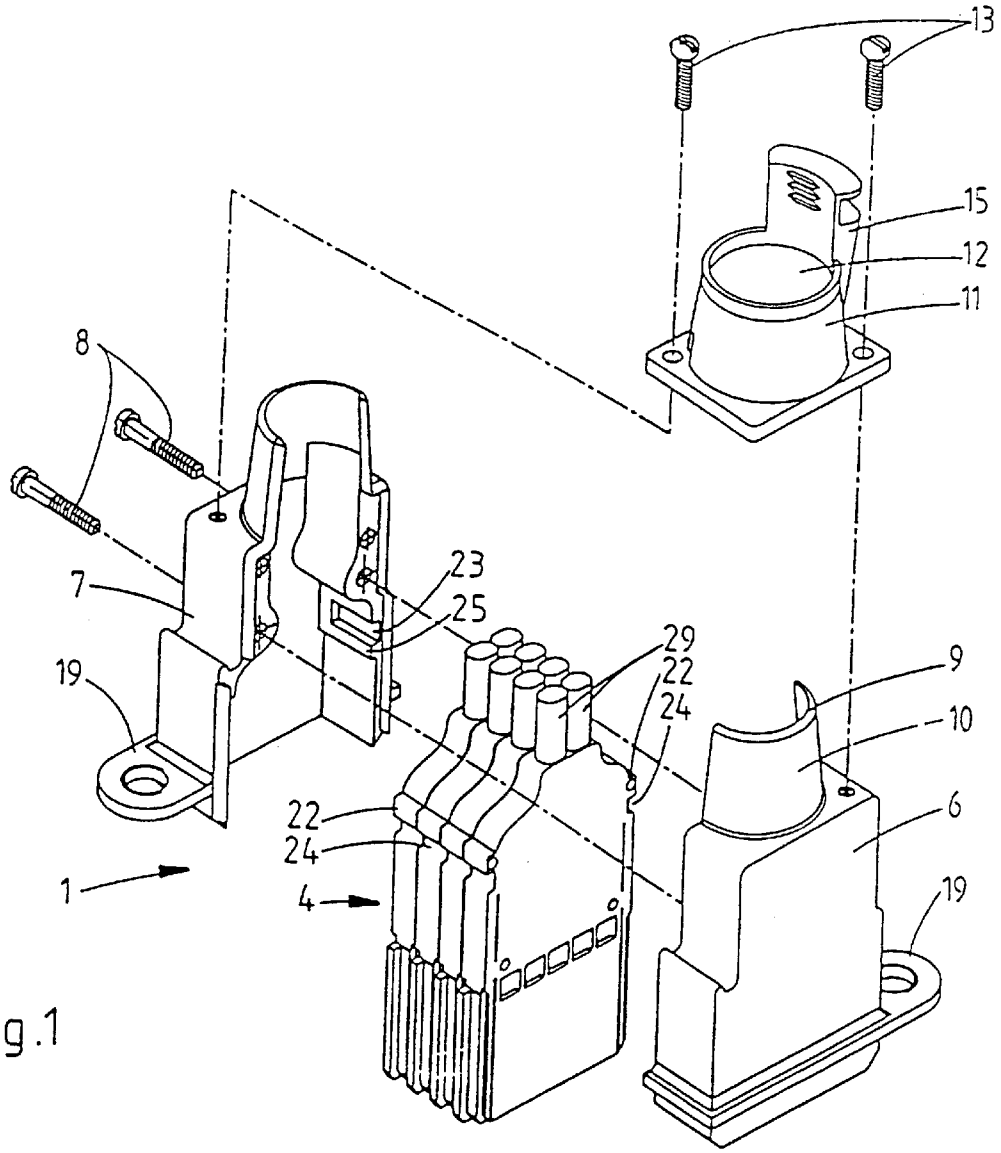
FIG. 1 shows a perspective exploded view of a first embodiment of a first connector the connector assembly of the invention.

FIG. 1 schematically shows that two twinaxial cables 29 are connected to each module 26, so that the cable 2 in this embodiment comprises eight twinaxial cables 29. The construction of the module 26 is further described in EP-A-0 620 616.

Figure 7:
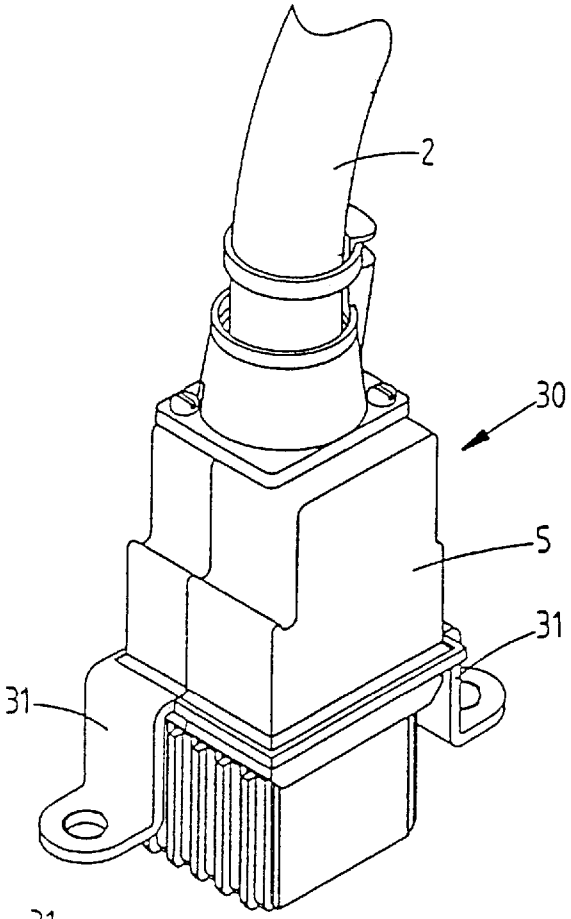
FIG. 7 shows the first connector of FIG. 6 as assembled.
Figure 6:
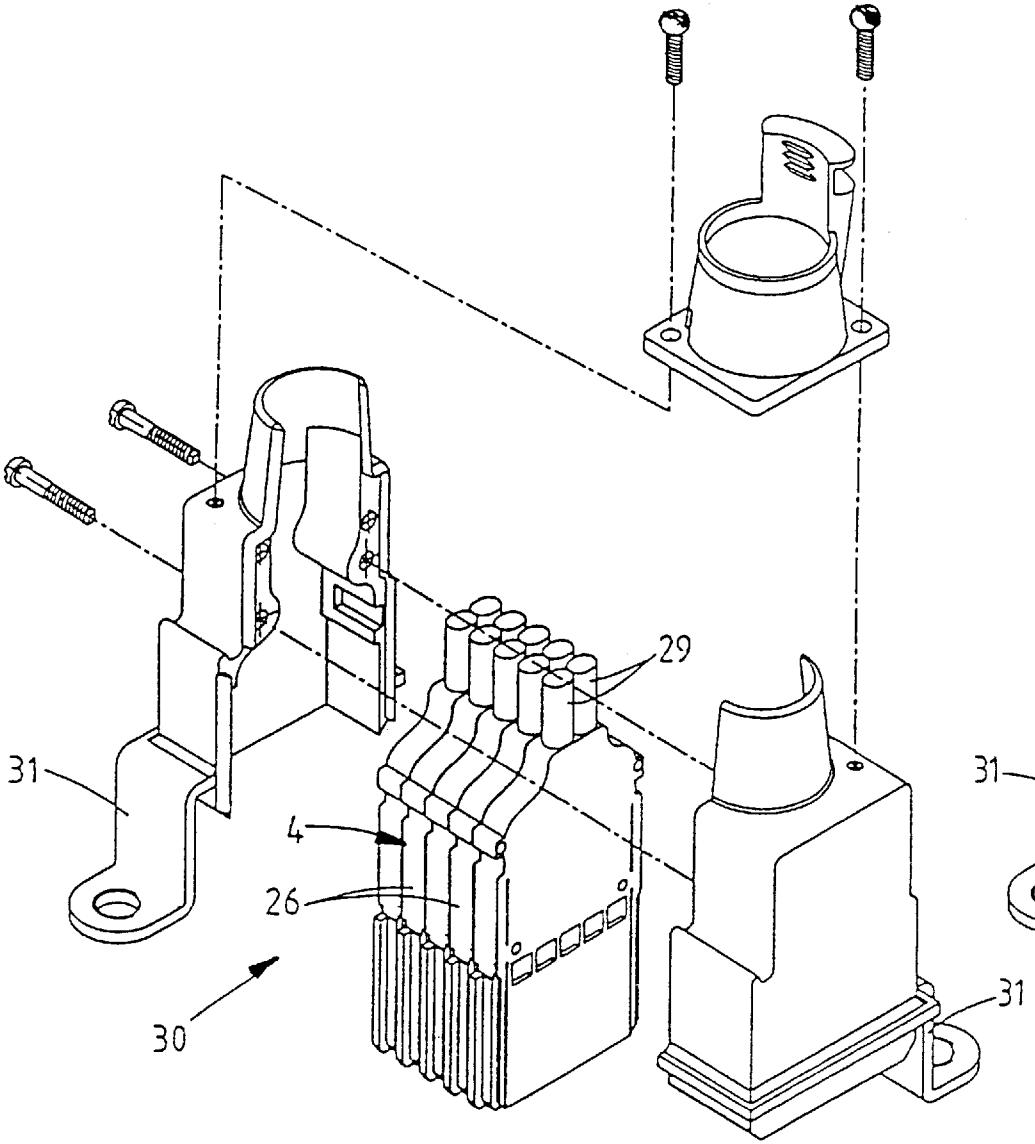
FIG. 6 shows a second embodiment of a first connector of the connector assembly of the invention in a perspective exploded view.

FIGS. 6 and 7 show a second embodiment of the first connector of the invention indicated by reference numeral 30. This connector 30 mainly corresponds with the connector of FIGS. 1–5, so that a detailed description is not necessary. In this case the housing 4 is an assembly of five modules 26 so that the cable 2 comprises ten twinaxial cables 29. The hood 5 of the connector 30 is provided with L-shaped flanges 31 one leg of which joins the hood 5.

Figure 9:
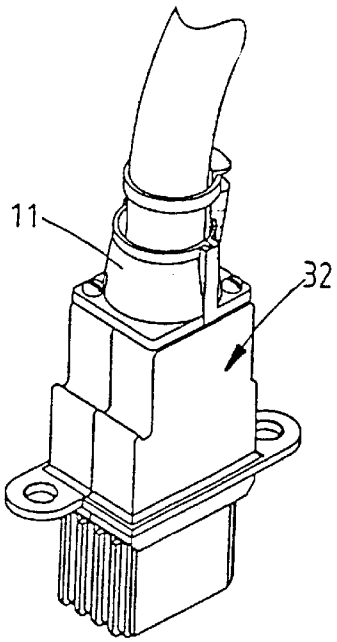
FIG. 9 shows the first connector of FIG. 8 as assembled.
Figure 8:
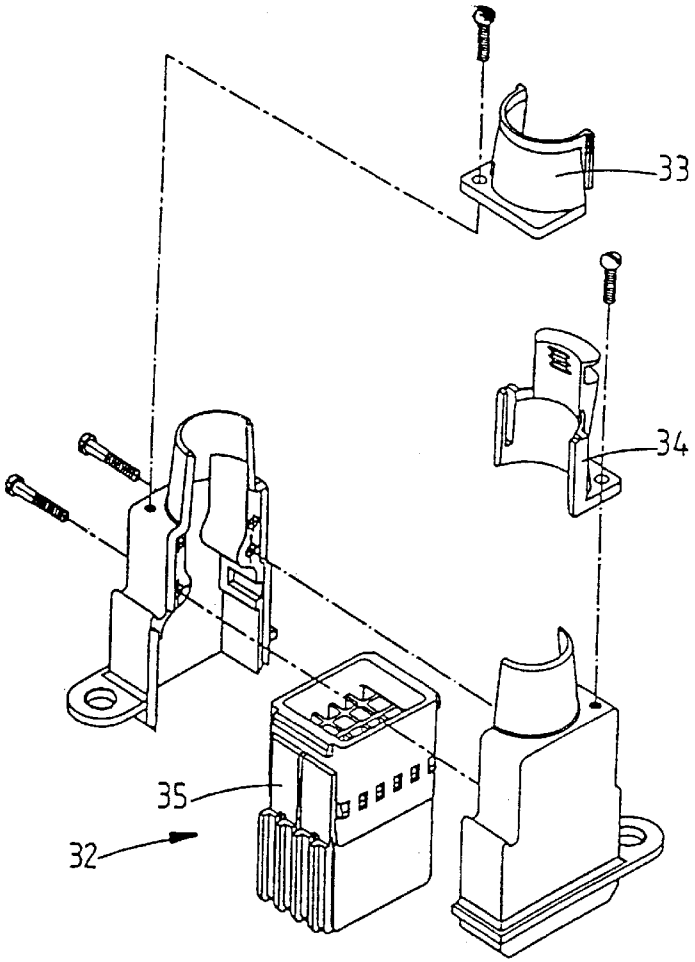
FIG. 8 shows a third embodiment of a first connector of the connector assembly of the invention in a perspective exploded view.
Figure 10:
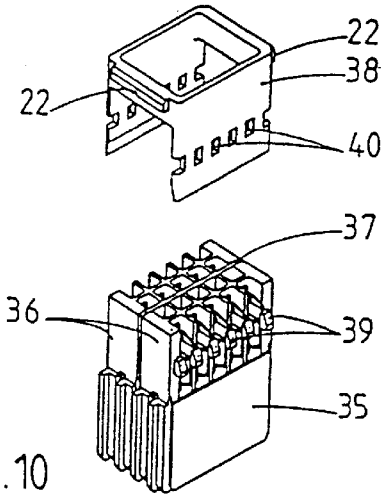
FIG. 10 shows the housing of the first connector of FIG. 8 as partially disassembled.

FIGS. 8–10 show a third embodiment of the first connector of the invention indicated by reference numeral 32. The connector 32 mainly corresponds with connector 1 and is therefore neither described in detail. In this case the ring 11 comprises two parts 33 and 34 as further described in the above-mentioned U.S. patent application Ser. No. 08/627,451.

The connector 32 comprises a housing 35 which is an assembly of two parts 36 with an intermediate insulating plate 37 as shown in FIG. 10. A cover 38 of insulating material is mounted on the two parts 36, wherein lugs 39 of the housing parts 36 engage into openings 40 of the cover 38. In this case the cover 38 includes the lugs 22 for attaching the housing 35 into the hood 5.

Figure 11:
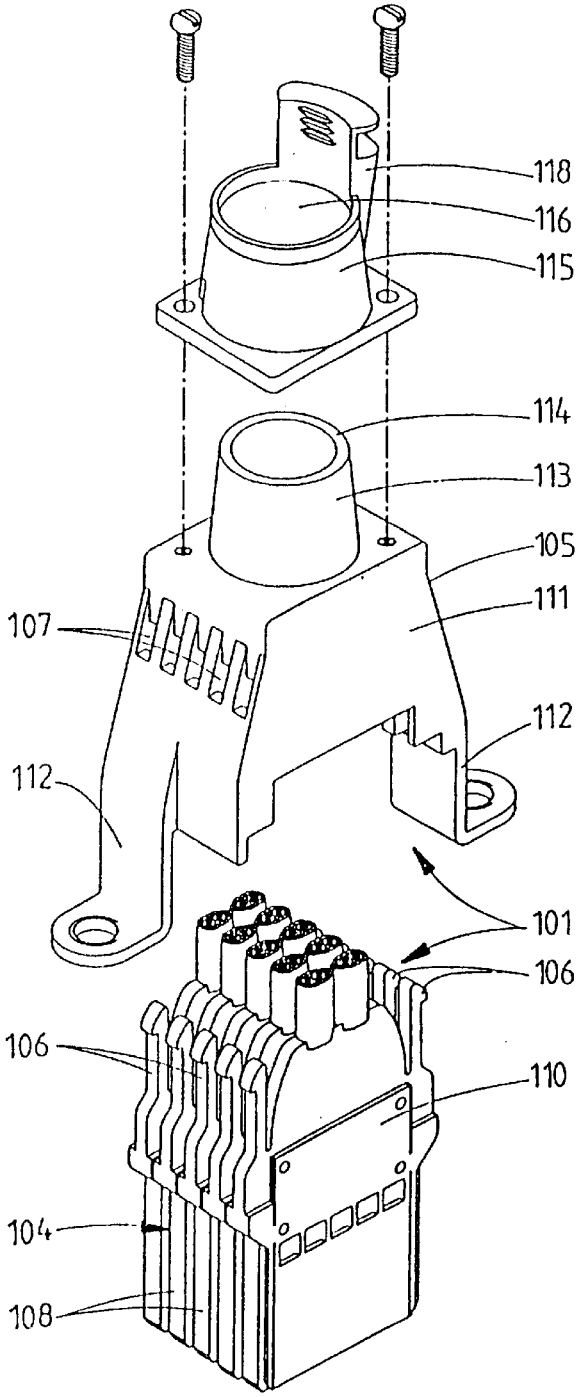
FIG. 11 shows an exploded view of a fourth embodiment of a first connector of the connector assembly of the invention.
Figure 12:
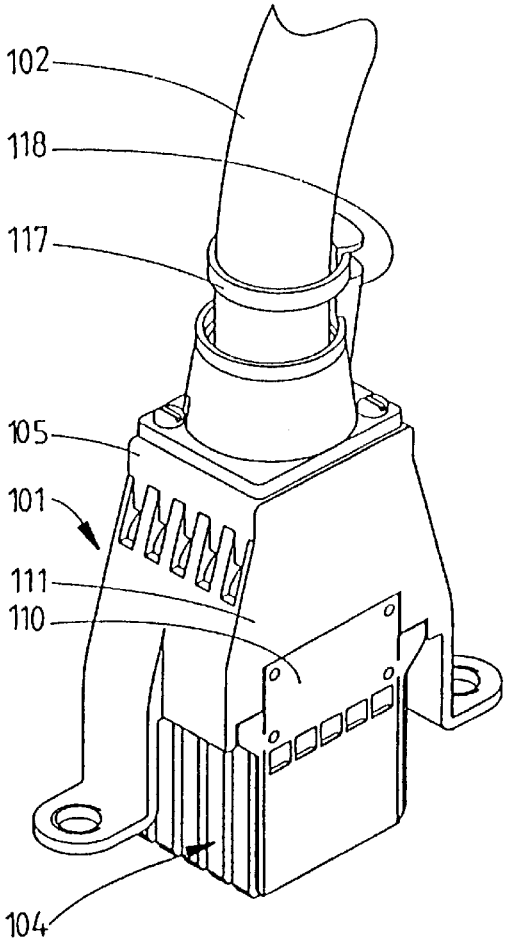
FIG. 12 shows the first connector of FIG. 11 as assembled.
Figure 13:
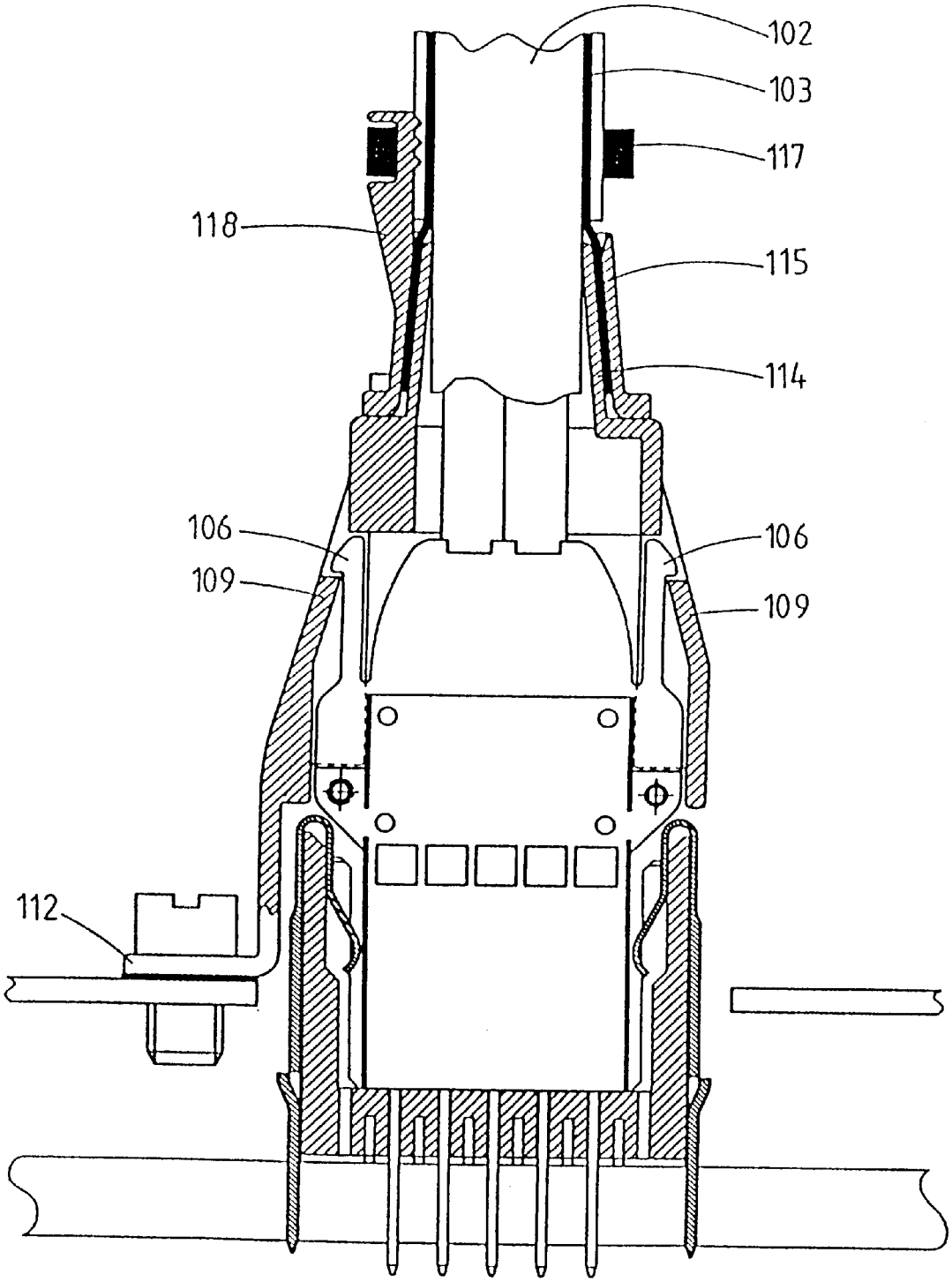
FIG. 13 is a very schematically shown cross-section of the first connector of FIG. 11 as inserted into a second connector of the connector assembly of the invention.

In FIGS. 11–13 a fourth embodiment of the first connector of the invention is shown, a cable 102 with a plurality of conductors not further shown and a shielding 103 shown in FIG. 13, being connected to this first connector 101. The connector 101 is provided with a housing 104 of insulating material in which contacts not shown are received, wherein the conductors can be connected to the contacts. The connector 101 further comprises a metal hood 105 made as one piece.

The housing 104 is detachably mounted in the hood 104 by means of springy latching hooks 106 engaging into latching openings of the hood 105. The housing 104 is an assembly of five modules 108 which are interconnected by means of pins and bores as described above. Each module 108 includes two latching hooks 106.

The latching openings 107 of the hood 105 are made as passages through the side walls 109, so that the latching hooks 106 are accessible from the outer side and can be pressed out of the latching openings 107 to release the housing 104.

The housing 104 has two opposite outer walls 110, only one being shown in the drawings, said outer walls being in one plane with the corresponding outer walls 111 of the hood 105. Thereby a second connector 101 can be inserted adjacent to a first connector 101 into a complementary connector for receiving two connectors 101, for example, in such a manner that the intermediate spacing between adjacent contact locations of two connectors 101 is equal to the intermediate spacing between adjacent contact locations within one connector 101. In other words, in this manner the connector 101 is stackable.

The hood 105 comprises two flanges 112 by means of which the hood 105 can be connected to the shielding surrounding the complementary connector schematically shown in FIG. 3 as described above.

The shielding 103 joins a conical outer wall 113 of an upright collar 114. A ring 115 is attached on the hood 104 and has corresponding conical inner wall 116, wherein the shielding 103 is clamped between both conical walls 113 and 116. The cable 102 is clamped against an extension 118 of the ring 115 by means of a clamping strip 117.

It will be understood that it is of course possible to adapt the hood for receiving the housing which is assembled of a higher or lower number of modules 108.

It is further noted that in the described fourth embodiment two twinaxial cables are connected to each module 108. Therefore, in this case the cable 102 comprises ten twinaxial cables. It is however also possible to connect other types of cables or conductors to the modules 108 or to use other types of modules.

The invention is not restricted to the above-described embodiments which can be varied in a number of ways within the scope of the claims.

What is claimed is:

1. An electrical connector assembly for connecting a shielded cable to a printed circuit board, said cable having a plurality of conductors and a common shielding, said connector assembly comprising a first connector having a metal hood, and a housing of insulating material with contacts, wherein the housing is accommodated in the hood and comprises an insertion part protruding out of the hood along a complete circumference of the hood, said connector assembly comprising a second connector with a conductive shielding member disposed at a distance from, and surrounding the second connector, said second connector having a receiving space for receiving said insertion part of the housing, wherein said second connector and said shielding member are mounted on the printed circuit board and said shielding member is connected to a ground connector of the printed circuit board, wherein said hood is provided with at least one projecting flange connected to the shielding member of said second connector when the insertion part of the housing is inserted into the receiving space of said second connector, wherein said housing is an assembly of a plurality of parts which are interconnected by a cover of insulating material, said cover having attachment means for attaching the housing to the hood.

2. An electrical connector assembly according to claim 1, wherein said hood comprises two parts being detachable interconnected and surrounding an upper part of the housing, wherein the hood and the housing are provided with co-operating attachment means for attaching the housing in the hood, and wherein the housing assembly includes a plurality of equal modules, each module having at least one pin at one side and at an opposite side an aligned bore for fittingly receiving the corresponding pin of an adjacent module.

3. An electrical connector assembly according to claim 1, wherein said at least one projecting flange has a substantially L-shaped cross-section, one leg of said L-shaped section being a downward extension of the hood.

4. An electrical connector assembly according to claim 1, wherein said hood is provided with projecting flanges at two opposite sides of the hood, both said flanges being connected to said shielding member.

5. An electrical connector according to claim 1, wherein each module has a lug and a recess at opposite sides, wherein said lugs and recesses of the assembled modules provide attachment means of the housing.

6. An electrical connector assembly for connecting a shielded cable to a printed circuit board, said cable having a plurality of conductors and a common shielding, said connector assembly comprising a first connector having a metal hood, and a housing of insulating material with contacts, wherein the housing is accommodated in the hood and comprises an insertion part protruding out of the hood along a complete circumference of the hood, said connector assembly comprising a second connector with a conductive shielding member lying at a distance from, and surrounding the second connector, said second connector having a receiving space for receiving said insertion part of the housing, wherein said second connector and said shielding member are mounted on the printed circuit board and said shielding member is connected to a ground connector of the printed circuit board, wherein said hood is provided with at least one projecting flange connected to the shielding member of said second connector when the insertion part of the housing is inserted into the receiving space of said second connector, said hood comprising two parts being detachable interconnected and surrounding an upper part of the housing, wherein the hood and the housing are provided with co-operating attachment means for attaching the housing in the hood, wherein the housing is an assembly of a plurality of adjoining modules, at least one of the modules having at least one pin at one side and at an opposite side an aligned bore, the aligned bore having a shape complementing a corresponding pin of an adjacent module for fittingly receiving the corresponding pin of the adjacent module therein, wherein when the pin of the adjacent module is located inside the bore, the pin is surroundingly fitted and held tightly within the bore.

7. An electrical connector assembly according to claim 6, wherein each module has a lug and a recess at opposite sides, wherein said lugs and recesses of the assembled modules provide attachment means of the housing.

8. An electrical connector assembly according to claim 6, wherein said housing is an assembly of a plurality of parts which are interconnected by a cover of insulating material, said cover having attachment means for attaching the housing to the hood.

9. An electrical connector assembly for connecting a shielded cable to a printed circuit board, said cable having a plurality of conductors and a common shielding, said connector assembly comprising a first connector having a conductive hood, and a housing of insulating material with contacts, wherein the housing is accommodated in the conductive hood and comprises an insertion part protruding out of the conductive hood along a complete circumference of the conductive hood, said connector assembly comprising a second connector with a conductive shielding member lying at a distance from, and surrounding the second connector, said second connector having a receiving space for receiving said insertion part of the housing, wherein said second connector and said shielding member are mounted on the printed circuit board and said shielding member is connected to a ground connector of the printed circuit board, wherein said conductive hood is provided with at least one projecting flange connected to the shielding member of said second connector when the insertion part of the housing is inserted into the receiving space of said second connector, wherein said conductive hood is made as an integral part and said housing has springy latching hooks which are engaged into latching openings of the conductive hood for detachably mounting the housing in the conductive hood, and wherein said latching openings of the conductive hood are passages through the side walls of the conductive hood for allowing the latching hooks of the housing to be pushed out of the latching openings from outside the connector assembly.

10. An electrical connector assembly according to claim 9, wherein said housing has two opposite outer walls being coplanar with corresponding outer walls of the conductive hood.

11. An electrical connector according to claim 9, wherein said housing is an assembly of a plurality of equal interconnected modules, each module being provided with two latching hooks.

* * * * *